United States Patent [19]

Dhooge et al.

[11] 4,056,264

[45] Nov. 1, 1977

[54] STACK FORMING DEVICE

[75] Inventors: Alfons Leon Dhooge, Zwijndrecht; Joseph Marie Cappuyns, Berchem, both of Belgium

[73] Assignee: AGFA-GEVAERT N.V., Mortsel, Belgium

[21] Appl. No.: 680,370

[22] Filed: Apr. 26, 1976

[30] Foreign Application Priority Data

Apr. 28, 1975 United Kingdom ..... 17566/75

[51] Int. Cl.[2] ..... B65H 29/22; B65H 29/24

[52] U.S. Cl. ..... 271/177; 271/80; 271/178; 271/184; 271/195; 271/196; 271/211; 271/224

[58] Field of Search ..... 271/80, 196, 195, 211, 271/177, 178, 181, 184, 188, 223, 224; 29/120

[56] References Cited

U.S. PATENT DOCUMENTS

| | | | |
|---|---|---|---|
| 2,237,429 | 4/1941 | Harrington | 29/120 X |
| 2,615,714 | 10/1952 | Ford | 271/223 |
| 2,645,480 | 7/1953 | Long | 271/177 |
| 3,052,467 | 9/1962 | Fertig | 271/188 |
| 3,545,746 | 12/1970 | Ledger et al. | 271/196 |

OTHER PUBLICATIONS

Bach, P. S. "Paper Inserter and Stacker Bin", IBM Technical Disclosure Bulletin, vol. 17, No. 9, Feb. 1975, pp. 2535, 2536.

Agfa Gevaert, "Sheet Guides", Research Disclosure, No. 112, Aug. 1973, pp. 21, 22.

*Primary Examiner*—Bruce H. Stoner, Jr.
*Attorney, Agent, or Firm*—William J. Daniel

[57] ABSTRACT

The stack forming device according to the invention comprises a traction surface which is rotatably driven. The portion of the trailing edge of a sheet to be stacked is kept in contact with the traction surface so that the trailing edge of the sheet is displaced in synchronism with said surface. This displacement is carried out over a period which follows the abutment of the leading edge of the sheet against a stop provided on a stacking platform. As a consequence the sheet acquires a convex configuration and is finally propelled against the platform or the preceding sheet after release by the traction surface. The device may be equipped with supplementary blowers in order to facilitate the release from the traction surface. It is of particular interest for high speed stacking of photographic film sheets, preferably double-side coated ones.

6 Claims, 3 Drawing Figures

STACK FORMING DEVICE

This invention relates to a method and apparatus for forming a stream of flexible sheets into a stack.

In industry it is often necessary to form individual sheets, e.g. sheets being delivered from sheet-forming and/or sheet processing installations, into dressed stacks ready for storage or packaging.

It is known to deliver the successive sheets from delivery rolls onto a platform where the delivered sheets accumulate one on top of another. The known methods and apparatus working in this manner are not capable of forming rapidly delivered sheets into a stack in which the sheet edges are in proper registration. Above a certain rate of sheet delivery the delivery of one sheet onto the stack is hindered by the previous sheet. Time is required for the previous sheet to settle in position before the next sheet arrives.

The present invention provides a method which is capable of higher stacking rates.

According to the present invention, there is provided a method of stacking a succession of sheets wherein sheets are successively delivered edgewise from a propulsion means including a rotating traction surface into a position over a stack supporting platform where they are arrested by abutment of their leading edges against a stop; wherein on leaving said traction surface the leading edge of each sheet is caused to travel into a position in which it is supported on said platform (or the previously delivered sheet if any) and is in abutment with said stop while the trailing margin of the sheet is still in contact with said traction surface, the sheet at this time being cured and convex towards the platform; and wherein following such abutment, said traction surface, by its continued rotation, propels such trailing sheet margin towards the platform and releases it so that the sheet assumes a condition on and supported uniformly by the platform or underlying sheet, said method being characterized in that the tangent to the traction surface at the place where the leading edge of a sheet leaves this surface intersects this platform between the position where the stop is located and the position where the trailing edge of the sheet comes to be supported on said platform.

This method may be used with advantage for all kinds of sheet materials, in combination with all types of sheet-handling or sheet-making machines.

A particularly important potential application of the invention is in the high-speed stacking of X-ray film sheets. The introduction of film manufacturing methods which enables a higher production output calls for the design of cutting and stacking apparatus which are able to follow this increased rate of production. A method according to the invention has been found to be capable of stacking sheets at a rate of several hundred sheets per minute and thus meets an important need in the photographic industry.

The method is not only capable of high-speed performance but affords the further advantage that the sheets can be delivered in such good registration that subsequent dressing of the sheets preparatory to subsequent handling, e.g. packaging, is unnecessary, or at the most requires very small relative movements of the sheets. This is of much importance in the case of sheets having sensitive surfaces which might be impaired by the frictional forces involved in substantial dressing operations. X-ray film sheets are a case in point. The photosensitive emulsions of these sheets may become seriously damaged by relative sliding movements of the sheets while they are pressed firmly together, as they are in a stack of appreciable thickness. There is no problem in ensuring side edge registration of the delivered sheets. The lateral position of the sheets in a feeder can be easily ensured by side edge guide means as known per se. The platform on which the sheets are to be stacked will usually be flat, and in this case, the invention provides that the stacked sheets assume a flat condition thereon. The remainder of this description will be directed to the use of a flat platform, but it should be borne in mind that this is not essential to the performance of the invention.

The traction surface is preferably the surface of a roller. As an alternative such surface may be provided by a belt. In any case it is preferable for the said surface to follow an arcuate path of constant radius from the position where the leading edges of the sheets leave this surface to the position where the trailing edges of the sheets leave this surface. As the trailing margin of a sheet follows this arcuate path the straight line distance from the trailing edge of the sheet to its leading edge (which is against the stop) initially shortens, so that the sheet becomes flexed or more strongly flexed. Thereafter the said straight line distance increases and the elastic recovery forces in the sheet can bring it into a "flat" condition as the sheet loses contact with the traction surface. This behaviour of the sheets is assisted if the sheets have a measure of stiffness and inherent elastic flexibility. This is a reason which makes the method particularly well suited for handling sheets of polyester or other polymeric sheets of a thickness within the conventional range for X-ray film supports.

It is desirable for the traction surface to be of a rough texture or to be grooved or otherwise formed for frictionally or positively engaging the trailing edges of the sheets and preventing them from slipping relative to such surface during the period of the sheet delivery cycle when the aforesaid straight-line distance is shortening.

At the present stage of development of the invention it is considered advantageous to adopt one or more of the following further features:

a. The tangent to the traction surface, at the place where the leading edge of a sheet leaves this surface, intersects the platform between the position where the stop is located and the position where the trailing edge of the sheet comes to be supported thereon;
b. one or more gas streams are delivered over the platform and towards the stop to support or assist in supporting the leading end portion of a sheet as it travels towards the stop;
c. one or more gas streams are delivered towards the support so as to assist the "flattening" of each sheet onto the platform or onto the previously delivered sheet (if any) during the part of the delivery cycle following the abutment of the leading edge of the sheet against the stop;
d. a guide surface is provided for contacting the leading end of a sheet from above and ensuring its contact at the stop position with the platform or the underlying sheet (if any).

Feature (a) is useful for ensuring that the leading portion of each sheet moves quickly onto the platform or underlying sheet on losing contact with the underlying traction surface. Rapid clearance of the delivery path for the next sheet is thus promoted. Feature (a) also ensures that on arrest of the leading edge of the sheet this sheet is sigificantly convexly flexed towards the platform so that energy is stored in the sheet which, when the sheet is released from the traction surface, will assist rapid "flattening" of the sheet onto the platform or previously delivered sheet.

Feature (b) is valuable in avoiding undesirable siding friction between a sheet being delivered and a previously delivered sheet on the platform. This feature is thus recommended in particular when handling sheets which are liable to be impaired by such friction. Feature (b) is very advantageous in conjunction with feature (a) because it enables that feature to be adopted without undue sliding friction occurring.

Feature (c) assists the correct and rapid "flattening" of a sheet being delivered by supplementing the tractive forces exerted on the trailing edge of the sheet by the underlying traction surface during the last part of the delivery cycle.

Feature (d) prevents "riding-up" of the leading edge of a sheet from the platform or underlying sheet during the last part of the delivery cycle during which the said edge is against the stop and the sheet is being subjected to flexing forces by the rotating traction surface. Feature (d) moreover prevents the leading edge portion of a sheet from being lifted from the support or underlying previously delivered sheet by the supporting gas stream or streams (feature (b)) when such is or are employed.

Generally speaking it is desirable for a sheet stacking method to be applicable for stacking a stream of sheets conveyed horizontally or in a generally horizontal direction. Sheets being conveyed on a generally horizontal conveyor to the underlying traction surface employed in the present invention must remain in contact with such surface over a certain arcuate path in order to be propelled downwardly, e.g. vertically downwardly or at a downward inclination. Preferably this contact is maintained by suction forces. Thus, according to a preferred feature, the traction surface is the surface of a roller having air passages which over a given sector are in communication with a space at subatmospheric pressure. However the invention includes a method wherein the sheet propulsion means includes co-operating rollers between which the sheets are fed and in that case the rollers may be arranged to guide the sheets along any required arcuate path from the feed point to their delivery point from the propulsion means.

The platform is preferably steeply inclined to the horizontal from a position beneath the traction surface to a lower position where the stop is located.

The invention includes any apparatus constructed to enable it to carry out a method according to the invention as hereinbefore defined.

In particular the invention includes any apparatus wherein there is propulsion means including a driven rotary traction surface for propelling sheets fed thereto onto a stack-supporting platform which is located for receiving the sheets and with which stop means is associated for contact by the leading edges of the sheets during their propulsion; and wherein there is means for maintaining the trailing end portion of a sheet in contact with said surface and in movement therewith during a period of rotation following the abutment of the leading edge of the sheet against said stop means thereby to cause such trailing end portion to be propelled towards the part of the platform on which it will be supported when the sheet is supported uniformly thereon, said apparatus being characterized in that the tangent to the traction surface at the place where the leading edge of a sheet leaves this surface, intersects the platform between the position where the stop is located and the position where the trailing edge of the sheet comes to be supported thereon. Preferably the said traction surface is the surface of a roller. Preferably the said means for maintaining the trailing end portion of a sheet in contact with said surface operates by friction.

In preferred embodiments of apparatus according to the invention the apparatus includes means for performing a method according to the invention which includes any one or more of features (a) to (d) hereinbefore referred to.

The scope and spirit of the invention will be exemplified by a description of a preferred embodiment and with reference to the accompanying drawings in which.

Figure 1:
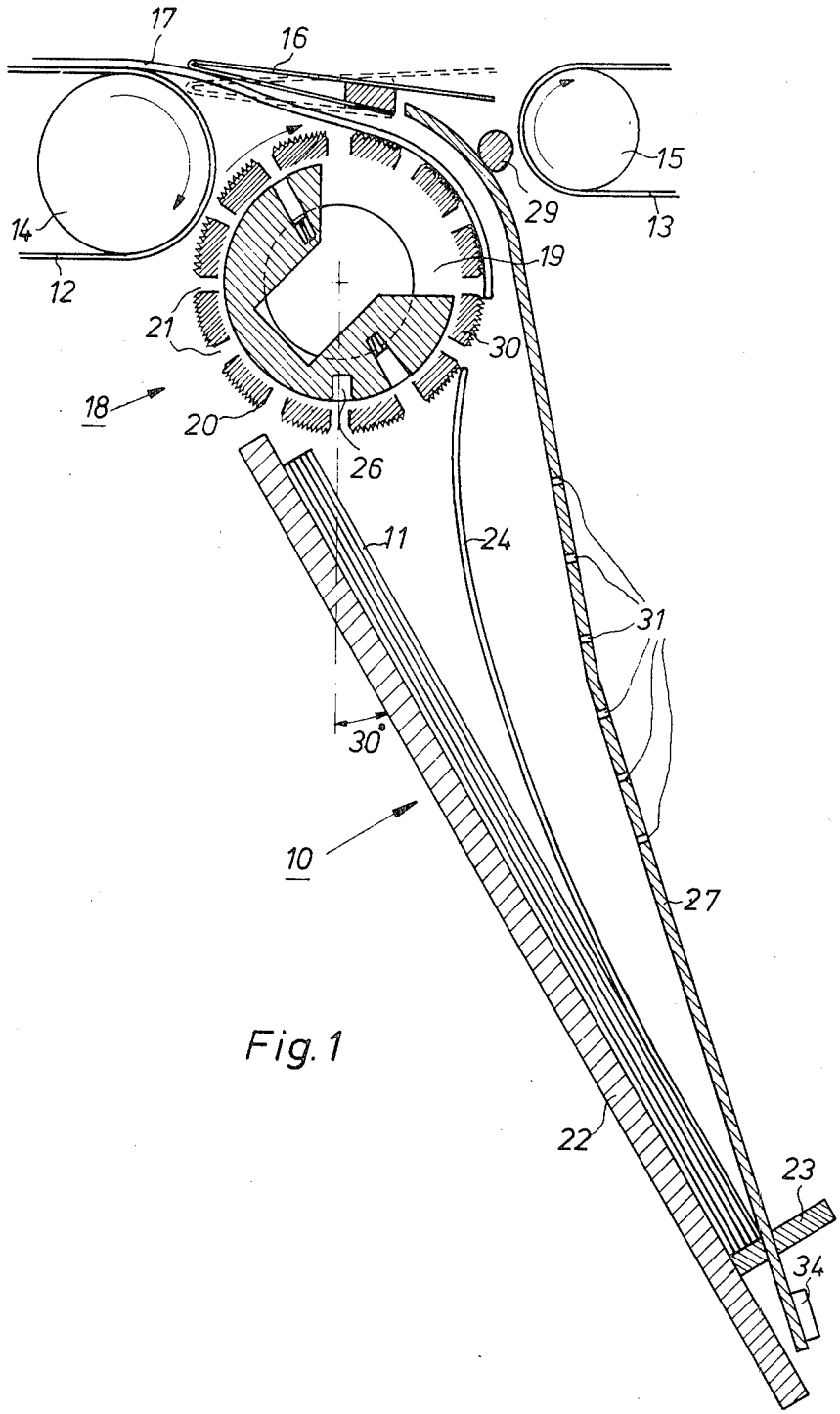
FIG. 1 is a sectional view of the apparatus according to the invention.

In FIG. 1 the device 10 for forming a stack 11 of sheet-like material is supposed to form part of a line (not represented) for cutting a web into individual sheets.

The device 10 is located between two endless belts 12 and 13, supported at one side by wheels 14 and 15 respectively. A finger 16 is also placed between the endless belts 12 and 13. The finger 16 may occupy two positions, one position (indicated in dotted lines) in which the sheets may be transferred from endless belt 12 towards endless belt 13, and a position (indicated in full lines) in which the passage of the sheets is obstructed by means of the upwardly extending part of the finger 16. In the FIGURE, such obstruction is illustrated for a sheet 17. The finger 16 may be actuated by means of a flaw detecting system (not shown), which responds to anomalies in the structure of the film surface, such as streaks and other types of flaws. In the case of dual collecting systems, the finger 16 will serve to convey sheets to be stacked to a first stacking device, while another stacking device is engaged in emptying.

Under the finger 16, a roller 18 is provided which has a built-in suction chamber 19 extending by about 90° over its periphery. The jacket 20 of the roller 18 is roughened or provided with or formed from a high friction material and has a series of holes 21 through which a vacuum may be transferred from the inside of the roller. Beneath the roller 18, a platform 22 is provided onto the which the stack 11 is formed. Preferably the platform 22 takes an inclined position. The optimum inclination itself depends on the kind of sheets to be stacked and may vary between 30° and 85° with respect to the perpendicular line. At its lower end, the platform 22 is provided with an abutment member 23 for alignment of the sheets to be stacked.

As characteristic feature of the arrangement formed by the platform 22, its abutment member 23 and the roller 18 may be cited that the shortest distance between said abutment member and the roller is less, say 5%, than the longitudinal dimensions of the sheet to be stacked. Also the distance between the abutment member and the roller axis is greater than such sheet dimension.

A film sheet 17, being transported by the endless belt 12 and intercepted by the finger 16 will be forced to make an intimate contact with the surface of the roller 18 due to the vacuum prevailing in the same through holes 21. This contact may e.g. last over 45° to 180°, but is preferably about 90° so that the sheet is firmly held and advances at a linear speed equal to the peripheral speed of the roller, and no mutual displacement between the film and the surface of the roller occurs.

When part of the sheet 17 has left the area in which vacuum is applied, it advances downwardly and when the whole surface of the sheet 17 has passed through said area, the leading edge of the sheet is urged against the abutment member 23. As the distance between said abutment member and the closest point of the roller is smaller than the longitudinal dimension of the sheets to be stacked, the trailing edge of the sheet has not yet passed this point and the sheet itself gets a concavely shaped configuration. However, the uppermost sheet edge will be engaged by the roller which may be provided with a specially selected high friction surface, and as the roller 18 continues to rotate, that edge is urged towards the platform 22 and is eventually released to fall against the stack. This ensures that the lowermost sheet edge is urged against the abutment 23 and will remain in contact therewith rather than bouncing away again as has been a problem in some prior art systems.

In order to render the stacking operation more reproducible, supplementary expedients may be provided. The stacking device may be provided with a guide 27 which is pivotally arranged around a shaft 29 lying in parallel relationship with the roller axis, the platform 22 and the abutment member 23, so that the sheets to be stacked will always be forwarded towards the abutment member. The guide 27 is suitably fitted with one end (the upper) to the shaft 29 e.g. by welding. In this way its lower end may gradually move in upward direction in dependence on the height of the stack 11. In the guide 27, which in a preferred embodiment, has a railing-like structure, channels 31 may be provided and through which air may be blown in order to create a supplementary force acting upon the upper sides of the sheets as they are stacked. In so doing a more efficient grip between the surface of roller 18 and the trailing edge of the sheet may be established, so that a direct contact between the film 24 and the guide 27 is avoided and any risk of creating streaks or other mechanical damage upon the surface of the film is reduced. At the lowermost point of the roller 18, another supplementary blower slot 26 is provided which serves to create a kind of air cushion between the already stacked sheets and those being supplied. In this way the frictional forces between sheets which move across the surface of the stack and the top sheet of the stack will be reduced. Moreover, the presence of the blower slot 26 has another favourable effect in that thin layers of air are formed between the individual sheets forming the stack 11, so that the risk for the sheets of getting stuck to each other is greatly reduced.

The combination of the working action of the guide 27, its associated blower channels 31 and the blower channel 26 will result in that the sheets to be stacked, after leaving the surface of the roller 18, are exactly and reproducibly driven towards the abutment member 23 and are canted by the resultant blowing action of the blowers 31 and 26, so that they are gently positioned upon the stack 11.

As very little friction between the sheet 24 and machine parts or other sheets in the stack 11 occurs, electrostatic charging of the film is reduced to a very low level.

The operation of the device according to the invention, which is very reproducible, has been demonstrated by the visual aspect of stacks containing 125 X-ray film sheets which lie strictly in register with each other and by high frequently cinematographic techniques as well.

The periphery of the roller 18 is roughened or provided with a layer 30 of a material having a high coefficient of friction versus the film to be stacked in order to increase the adherent contact of the sheet 17 or 24 with the roller and to provide a more efficient grip on the trailing edge of the sheet when it has nearly attained its final position, as is shown for sheet 24. The material which is used to form the roller surface is preferably felt, but other materials having a high coefficient of friction versus the sheets may be used with the same favourable effect.

Figure 2:
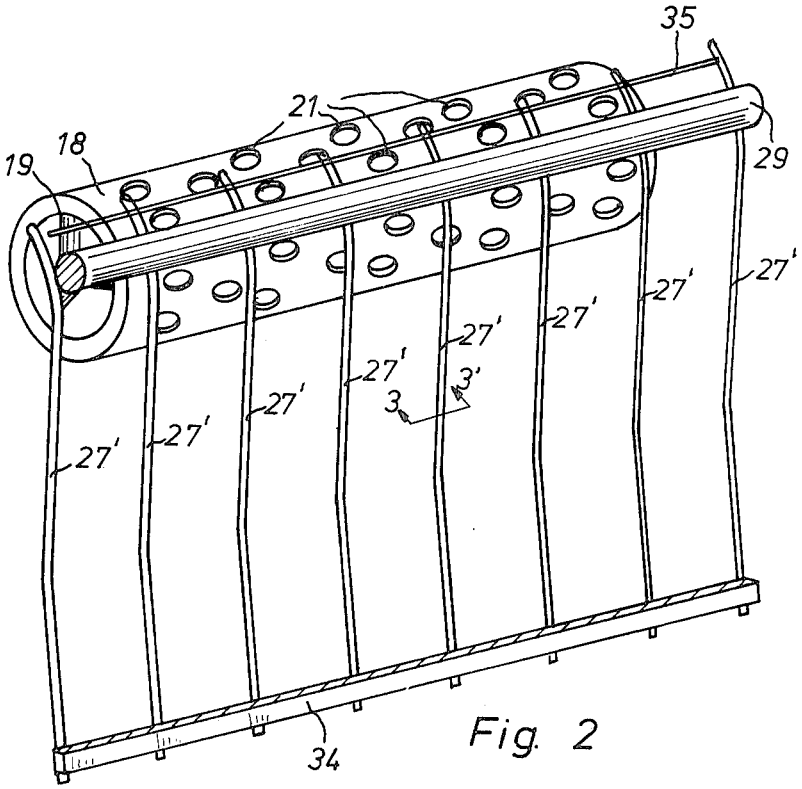
FIG. 2 is an isometric view of an arrangement of a guide member.

FIG. 2 shows an isometric view of a preferred embodiment of the guides which is designated 27. As may be seen they are arranged in a a railing-like structure and interconnected by means of bars 34 and 35. Bar 34 is of a heavier construction than bar 35 in order to avoid or at least to reduce possible oscillations of the guides 27' which are pivotally mounted on the shaft 29.

Figure 3:
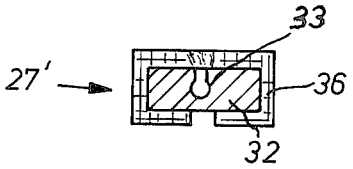
FIG. 3 is a sectional view of a detail of FIG. 2 along the line 3—3'.

The blower channels 31 which in FIG. 1 were represented as a series of individual holes through which pressurized air could be forced, may be formed by an embodiment as shown in FIG. 3, which represents a cross-sectional view of a guide 27' along the lines 3—3' in FIG. 2.

The guide 27' comprises a metallic core 32 in which a longitudinally extending groove 33 is provided. In this case the groove is of circular shape, but it will be understood that the cross section of such groove is of minor importance. The core 32 is enveloped by a strip of felt 36 or other porous material. The groove 33 is connected to a source of pressurized air (not shown) and the flow of air is forced through the pores of the strip material so that a longitudinally extending blowing device is formed in the dotted area which provides for a perpendicular flow of air upon the sheets to be stacked.

The device according to the invention may be mounted either as end station of a high-speed cutting machine or as an intermediary station for the collection of sheets which have to be eliminated as a consequence of the presence of faults on their surface. In the second embodiment, the device may be coupled with fault-detecting apparatus. Said fault-detecting apparatus may actuate a track-switch mechanism, such as the finger 16 in FIG. 1.

The device may be adapted for different formats by regulating the position of the abutment member 23. Large sized formats may be stacked with the same accuracy and at the same speed as small ones. When in operation, the apparatus attains a stacking capacity which is substantially higher than that obtained with prior art devices.

We claim:

1. A sheet stacking device for stacking a plurality of sheets delivered in sequence, comprising a stack supporting platform, a driven substantially continuous traction surface having an arcuate peripheral region disposed above one end of said platform with the lower side thereof proximate to said platform, said traction surface being aligned to engagingly contact the under face of a sheet to be stacked and by its movement to positively propel the sheet forward in a delivery direction, delivery means for delivering a sheet to be stacked to a point on a portion of said arcuate peripheral region of said traction surface generally opposite said platform end, stop means at the other end of said stack supporting platform for arresting and aligning the delivered sheets into a stack, said stop means and said rotary traction peripheral surface region being spaced apart at their closest points a distance less than the sheet length whereby the trailing sheet edge remains in engagement with said traction surface after the leading edge thereof has been arrested by said stop means and until said trailing edge has been displaced past said traction surface region by the continued movement of said traction surface to thereby positively propel said trailing sheet edge against said stack, guide means defining a delivery passageway with said generally opposite portion of said traction surface peripheral region and extending in spaced relation to said platform to a point at least adjacent said stack stop means, said guide means comprising an array of discrete elongated hollow members each extending with its length generally parallel to the sheet delivery direction, the individual members being spaced apart at plural points transverse of the sheet delivery direction, said hollow members having holes facing toward said stack for transmitting air under pressure toward said platform to bias a sheet being propelled by said traction surface toward said platform, and means adjacent the lower side of said traction surface peripheral region proximate said platform end for directing a flow of air generally in the direction of the surface of said sheet stack to cushion the delivery of an on-coming sheet onto said stack.

2. An apparatus according to claim 1, wherein said traction surface is of a rough texture for frictionally positively engaging the trailing edges of the sheets.

3. Apparatus according to claim 1, wherein the said traction surface is the surface of a roller.

4. Apparatus according to claim 1, wherein the traction surface is provided by felt.

5. Apparatus according to claim 1, wherein said traction surface is the surface of a hollow roller and is gas pervious, and means are provided for maintaining subatmospheric pressure within the roller.

6. Apparatus according to claim 1, wherein the position of said stop means is adjustable.

* * * * *